US010660169B1

(12) United States Patent
Candow et al.

(10) Patent No.: US 10,660,169 B1
(45) Date of Patent: May 19, 2020

(54) DIGITAL STANDBY CONTROL OF A LIGHTING DRIVER USING PEAK DETECTION OF PULSE WIDTH MODULATED OUTPUT REFERENCE CONTROL SIGNAL

(71) Applicant: Current Lighting Solutions, LLC, East Cleveland, OH (US)

(72) Inventors: Kevin Andrew Candow, Lakewood, OH (US); Jeffrey Glenn Felty, Elyria, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/264,718

(22) Filed: Feb. 1, 2019

(51) Int. Cl.
*H05B 37/02* (2006.01)
*H05B 33/08* (2020.01)
*F21Y 113/13* (2016.01)

(52) U.S. Cl.
CPC ..... *H05B 33/0851* (2013.01); *H05B 33/0815* (2013.01); *F21Y 2113/13* (2016.08); *H05B 37/0272* (2013.01)

(58) Field of Classification Search
CPC ..... H05B 37/0272; F21Y 2113/13
USPC ..... 315/246, 291
See application file for complete search history.

(56) References Cited

U.S. PATENT DOCUMENTS

2003/0057888 A1* 3/2003 Archenhold ..... H05B 33/0818 315/291
2008/0180037 A1* 7/2008 Srimuang ..... H05B 41/295 315/246
2011/0080110 A1* 4/2011 Nuhfer ..... H05B 33/0815 315/291

* cited by examiner

*Primary Examiner* — Thuy V Tran
(74) *Attorney, Agent, or Firm* — Buckley, Maschoff & Talwalkar LLC

(57) ABSTRACT

Provided is control method and a lighting system having a plurality of lighting elements that includes a power supply for supplying power, a lighting driver having a microcontroller and configured to receive power from the power supply and output power to the plurality of lighting elements for operation thereof, a control system in electrical or wireless communication with the microcontroller, and configured to communicate with the microcontroller, to control an operational mode of the plurality of lighting elements via the lighting driver, wherein the microcontroller is configured to transmit an output reference signal as a control signal, and a peak detection circuit that receives the output reference control signal from the microcontroller, and generates a standby control signal from the output reference control signal received, to thereby operate the plurality of lighting elements in an on or standby mode.

17 Claims, 5 Drawing Sheets

DIGITAL STANDBY CONTROL OF A LIGHTING DRIVER USING PEAK DETECTION OF PULSE WIDTH MODULATED OUTPUT REFERENCE CONTROL SIGNAL

FIELD

The technical field relates generally to a lighting control system. In particularly, a system and method for digital standby control of a lighting (LED) driver using peak detection of a pulse width modulated output reference control signal.

BACKGROUND

A lighting system e.g., a digital addressable lighting interface ("DALI") system, includes a control system for controlling an operation of a plurality of lighting elements (e.g., LEDs) via a lighting driver including a microcontroller for controlling the plurality of lighting elements based on control signals received from the control system. The control system controls various operational modes of the lighting elements such as on mode and a standby mode. During on/mode, the control system sends an output reference signal to the microcontroller, while during a standby mode it sends a standby control signal to the microcontroller, to turn the lighting elements off, and the lighting driver goes into a low power consumption mode.

In a typical lighting system, as shown FIG. 1, a microcontroller generates two control signals, a output reference voltage control signal (V2) and a standby voltage control signal (V3) and a circuit 20 is provided for supplying the signals V1 and V2 to a lighting driver to control the operational modes of lighting elements. Since there are two separate voltage control signals V1 and V3, two independent isolation devices (e.g., optocouplers) are typically required between the microcontroller and the power components of the LED driver, for both a reference control signal and a standby control signal.

It is desirable to provide a single source to generate both the reference control signal and the standby control signal, reducing component costs and required printed circuit board space utilization.

SUMMARY OF THE EMBODIMENTS

The various embodiments of the present disclosure are configured to provide a lighting system and a method for controlling two operational modes including an output reference control and standby control using a single output source.

In one exemplary embodiment, a lighting system having a plurality of lighting element is provided and includes a power supply for supplying power, a lighting driver comprising a microcontroller and configured to receive power from the power supply and output power to the plurality of lighting elements for operation thereof, and a control system in electrical communication with the microcontroller, and configured to communicate with the microcontroller, to control an operational mode of the plurality of lighting elements via the lighting driver, wherein the microcontroller is configured to transmit an output reference signal as the control signal, and a peak detection circuit configured to receive the output reference control signal and generate a standby control signal from the output reference control signal received to operate the plurality of lighting elements in an on or standby mode.

In another exemplary embodiment, a control method of the above-mentioned system is provided.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

Figure 1:
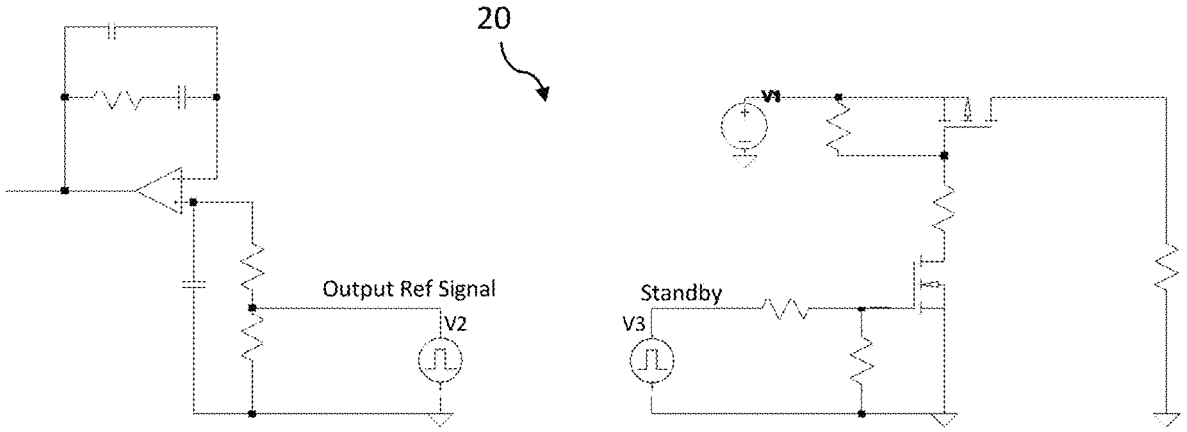
Prior Art FIG. 1
FIG. 1 is a circuit schematic illustration of a typical control operation of microcontroller to a lighting driver according to conventional methods.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 2:
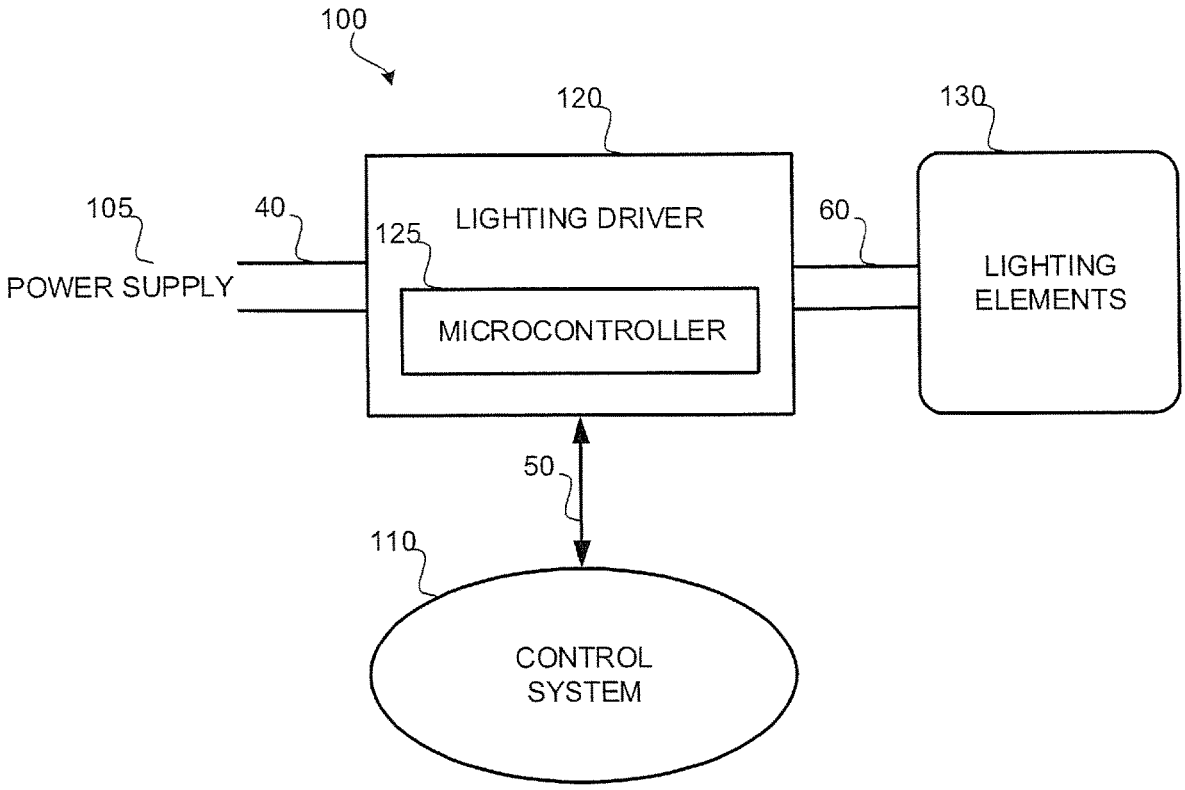
FIG. 2 is schematic illustration of a lighting system according to one or more exemplary embodiments of the present invention.

Exemplary embodiments of the present invention provide a lighting system and a method for controlling two operational modes including an output reference control and standby control using a single output signal from a microcontroller. FIG. 2 is an example of a lighting system 100 for which the embodiments of the present invention can be implemented.

As shown in FIG. 2, the lighting system 100 includes an AC power supply 105, a control system 110, a lighting driver 120, and a plurality of lighting elements 130 (LEDs). The lighting system 100 may be a digital addressable lighting interface (DALI) system or any other type of lighting system suitable for implementation of the exemplary embodiments shown in FIGS. 2 through 4. Some exemplary systems may include a lighting control system using 0-10V dimming leads. Other exemplary systems may include a lighting control system using Zigbee wireless lighting control.

According to one or more embodiments, the power supply 105 is configured to supply power to the lighting driver 120 for operating the lighting elements 130 via wires 40. In FIG. 1, the power supply 105 is external to the lighting system 100 however, the present invention is not limited to any particular power supply and therefore can vary, as necessary.

The lighting elements 130 may be light-emitting diodes (LEDs) such as semiconductor, organic or polymeric LEDs or similar devices. The lighting elements 130 are configured to receive output power from the lighting driver 120 and to emit light as controlled.

According to one or more embodiments, the control system 110 can be a DALI control system or any other suitable control system. The control system 110 is configured to control the lighting driver 120 by sending a control signal thereto, for controlling the various operations of the lighting elements 130, for example, on, dimming modes and a standby mode.

The lighting driver 120 (e.g., an LED driver), comprises a microcontroller 125 for receiving operation messages from the control system 110 and acting upon the messages by controlling the lighting driver 120 to operate the lighting elements 130 when needed, and transmitting messages to and from the control system 100 via wired or wireless connection 50. The microcontroller 125 may be programmable.

The lighting driver 120 converts the ac power supply 105 voltage and current to a constant voltage or constant current source for the lighting elements 130 via wires 60, may further comprises a connection to a current sensor of the overall lighting system 100 and a current converter for converting the power (in the form of input current) received from the power supply 105 into a lighting source current for supplying power to the lighting elements 130 via wires 60.

Figure 3:
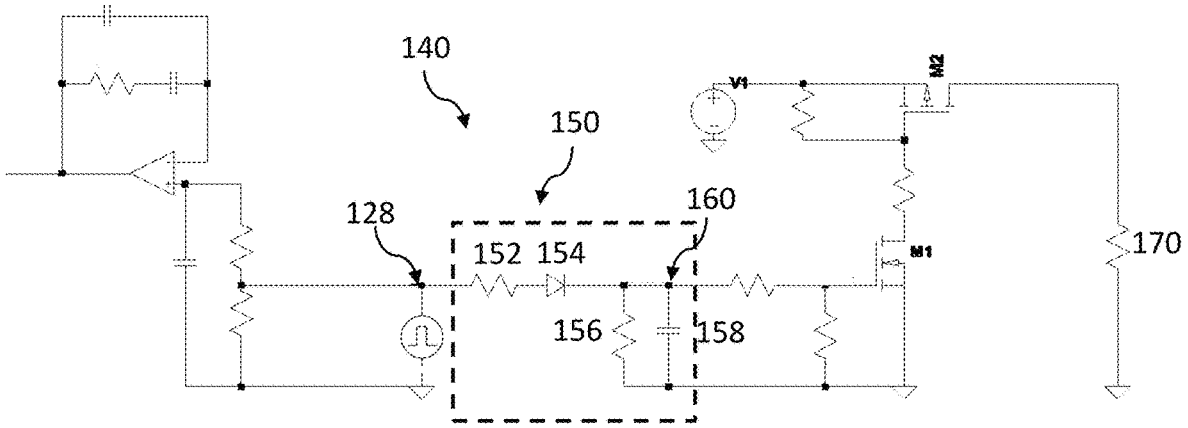
FIG. 3 is a circuit schematic illustration of the lighting system including control operation of the microcontroller to be implemented within the lighting system according to one or more exemplary embodiments of the present invention.
Figure 4:
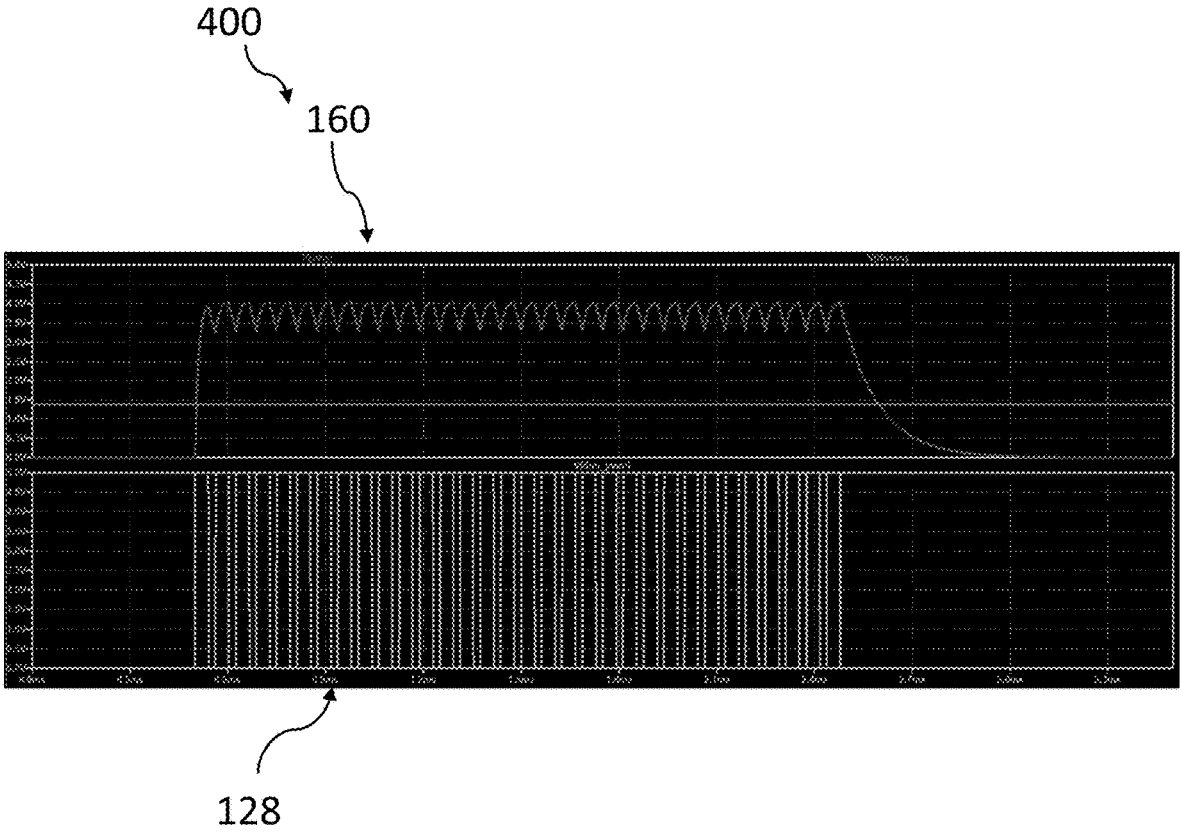
FIG. 4 is a graph illustration of a control operation of the lighting driver of FIG. 2 and the circuit of FIG. 3, using a single output signal, that can be implemented in one or more exemplary embodiments of the present invention.

Upon receiving a message from the control system 110, the microcontroller 125 generates a pulse width modulated signal (as depicted in FIG. 4) as an output reference control signal 128 to control the lighting driver 120. The lighting driver 120 performs operation of the lighting elements 130 using the signal 128 from the microcontroller 125. The output reference control signal 128 is also used to control a standby mode of the lighting driver 120. Details are discussed below with reference to FIG. 3.

As shown in FIG. 3, the lighting driver 120 comprises of a circuit 140. The circuit 140 includes a peak detection circuit 150 that receives an output reference control signal 128 (e.g., an LED dimming signal) from the microcontroller 125 and generates a standby control signal 160 to operate the lighting elements 130 in an on mode or standby mode. Since the output reference control signal 128 is used to generate the standby control signal 160, the output reference control signal 128 is only required to pass through a single electrical isolation device (e.g., optocoupler) between the microcontroller 125 and the circuit 140 thereby reducing the number of isolation devices compared to the conventional lighting system of FIG. 1.

The peak detection circuit 150 includes a first resistor 152 in series with a diode 154, a second resistor 156 and a capacitor 158. Upon receiving the output reference control signal 128, the peak detection device 150 generates the standby control signal 160 which is an exponentially decaying signal that is recharged at each pulse of the output reference control signal 128.

The circuit 140 further includes a plurality of semiconductor devices, transistors M1 and M2. While the minimum value of the repetitive waveform arising from the peak detection circuit 150 is greater than the gate threshold of M1, M1 will conduct current from drain to source, thus pulling down the gate of M2.

While the gate of M2 is pulled down, current will flow from source to drain in M2 and provide power to the load 170, where the load 170 further includes integrated circuits for power switching control in the lighting driver 120. According to embodiments of the present invention, M1 and M2 are n-channel type, and p-channel type metal-oxide semiconductor field-effect transistors (MOSFETs), respectively.

When the output reference control signal is turned off (set to zero), the peak detection circuit capacitor 158 will discharge to the point where it is less than the gate threshold of M1. M1 will no longer conduct current from drain to source, thus turning off the gate of M2. This causes M2 to stop conducting drain to source removing power to the load 170, allowing lighting driver 120 to enter low power consumption mode (standby mode).

As shown in FIG. 4, a graph 400 is provided, showing the output reference control signal 128 generated by the microcontroller 125 (as depicted in FIG. 3) and the standby control signal 160 generated by the peak detection circuit 150. As shown, there is a delay at the tail and leading edges of the standby control signal 160 in comparison to the output reference control signal 128. The time constant is adjusted to control the delay from the last pulse to the switch-off of the circuit. This adjustment is used to match desired operation instead of having to generate two independent control signals from the microcontroller 125.

Figure 5:
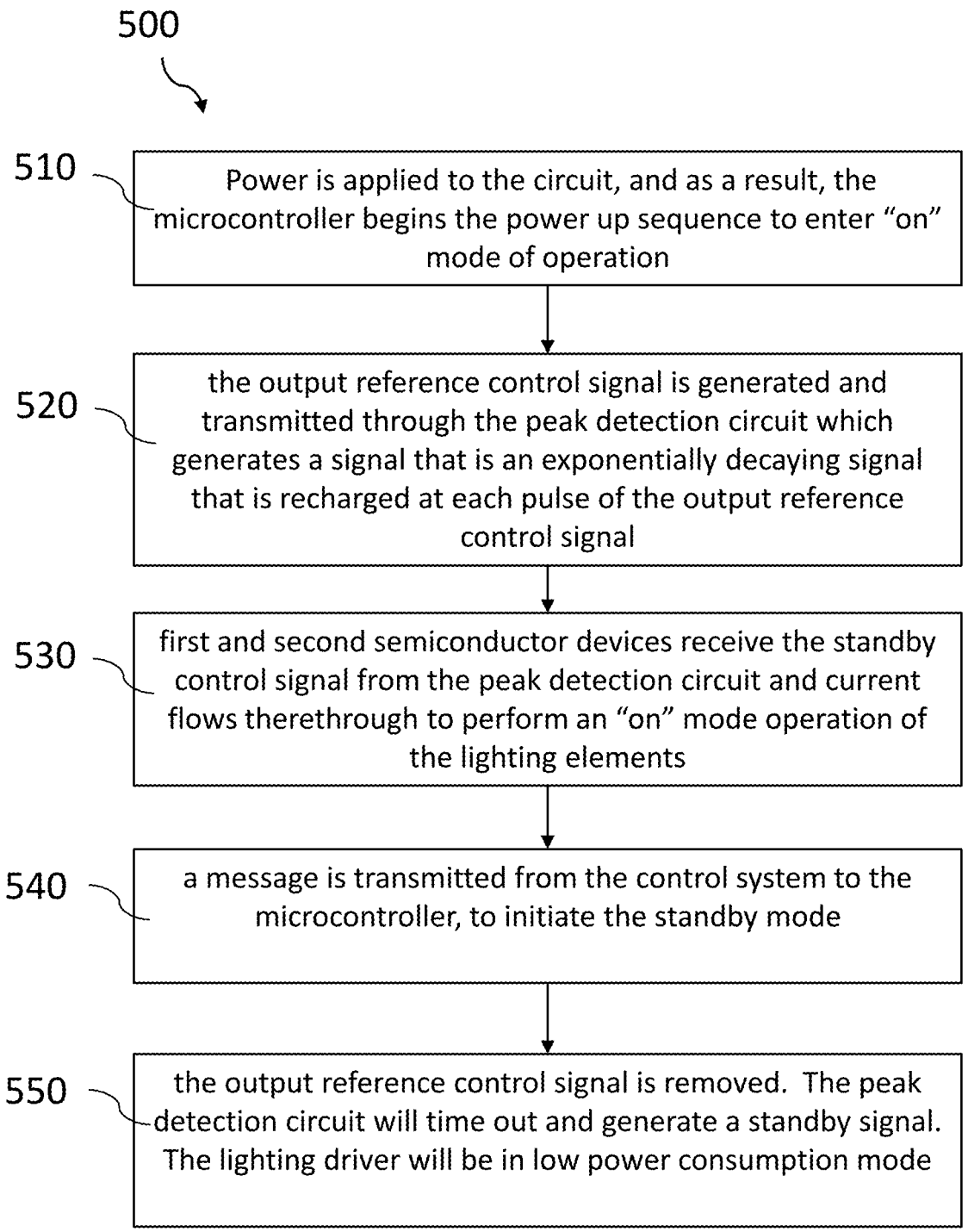
FIG. 5 is a flow diagram of an exemplary control method performed by the microcontroller of FIG. 2, that can be implemented according to one or more exemplary embodiments.

FIG. 5 is a flow diagram of an exemplary control method 500 for the lighting system 100 of FIG. 2, according to one or more other exemplary embodiments.

In operation 510, Power is applied to the circuit, and as a result, the microcontroller begins the power up sequence to enter "on" mode of operation.

From operation 510, the process continues to operation 520, where the output reference control signal is generated and transmitted through the peak detection circuit which generates a signal that is an exponentially decaying signal that is recharged at each pulse of the output reference control signal.

From operation 520, the process continues to operation 530, where first and second semiconductor devices receive the standby control signal from the peak detection circuit and current flows therethrough to perform an "on" mode operation of the lighting elements.

From operation 530, the process continues to operation 540, a message is transmitted from the control system to the microcontroller, to initiate the standby mode.

From operation 540, the process continues to operation 550, where the output reference control signal is removed. The peak detection circuit will time out and generate a standby signal. The lighting driver will be in low power consumption mode.

Some of the advantages of embodiments of the present invention, include that by reducing the number of independent isolation devices in the lighting driver, less printed circuit board space utilized for components, and the cost of the overall lighting system can be reduced. In addition, there is on less independent signal originating from the microcontroller thus allowing for less output pins needed and for a more cost-effective microcontroller to be employed to transmit the same amount of information.

This written description uses examples to disclose the invention, including the best mode, and also to enable any person skilled in the art to practice the invention, including making and using any devices or systems and performing any incorporated methods.

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A lighting system having a plurality of lighting elements, comprising:

a power supply for supplying power;

a lighting driver comprising a microcontroller and configured to receive power from the power supply and output power to the plurality of lighting elements for operation thereof;

a control system in electrical or wireless communication with the microcontroller, and configured to communicate with the microcontroller, to control an operational mode of the plurality of lighting elements via the lighting driver, wherein the microcontroller is configured to transmit an output reference signal as a control signal; and the lighting driver further including a peak detection circuit configured to: (i) receive the output reference signal from the microcontroller, and (ii) generate a standby control signal from the output reference signal received, to thereby operate the plurality of lighting elements in on mode or standby mode.

2. The lighting system of claim 1, wherein the power supply is configured to supply alternate current (AC) power to the lighting driver, for operating the plurality of lighting elements.

3. The lighting system of claim 1, wherein the microcontroller is programmable.

4. The lighting system of claim 1, wherein upon receiving a message from the control system, the microcontroller is configured to generate a pulse width modulation signal as the output reference signal.

5. The lighting system of claim 4, wherein the peak detection circuit comprising a first resistor connected in series with a diode, a second resistor and a capacitor, and is configured to generate the standby control signal as an exponentially decaying signal that is recharged at each pulse of the output reference signal.

6. The lighting system of claim 4, wherein the circuit further comprising: first and second semiconductor devices, each being a transistor, wherein when a minimum value of repetitive waveform arising from the peak detection circuit is greater than a gate threshold of the first semiconductor device, the first semiconductor device is configured to conduct current from drain to source, to thereby pull down a gate of the second semiconductor device, and provide power to the lighting elements during the on mode.

7. The lighting system of claim 6, wherein when the output reference signal is turned off, a capacitor of the peak detection circuit is discharged to a point where it is less than a gate threshold of the first semiconductor device and the first semiconductor device no longer conducts from drain to source thereby turning off the gate of the second semiconductor device and causing the second semiconductor device to stop conducting current drain to source removing power to a load and lighting driver enters the standby mode.

8. The lighting system of claim 6, wherein the first and second semiconductor devices are n-channel type and p-channel type metal-oxide semiconductor field-effect transistors, respectively.

9. The lighting system of claim 8, wherein a delay is generated in the standby control signal by the peak detection circuit.

10. A control method for controlling a lighting system having a plurality of lighting elements, the method comprising:

supplying power from a power supply;

receive power at a lighting driver, from the power supply and output power to the plurality of lighting elements for operation thereof;

transmitting a message, from a control system to a microcontroller of the lighting driver, to initiate on mode or standby mode;

generating an output reference control signal, via the microcontroller; and transmitting the output reference control signal to a peak detection circuit to generate a standby control signal.

11. The control method of claim 10, further comprising:

receiving, the standby control signal, at first and second semiconductor devices from the peak detection circuit and flowing current therethrough to perform an on mode operation of the lighting elements.

12. The control method of claim 11, wherein when a minimum value of repetitive waveform arising from the peak detection circuit is greater than a gate threshold of the first semiconductor device, conducting current at the first semiconductor device from drain to source, to thereby pull down a gate of the second semiconductor device, and providing power to the lighting elements during the standby mode.

13. The control method of claim 12, wherein when the output reference control signal is turned off, a capacitor of the peak detection circuit is discharged to a point where it is less than a gate threshold of the first semiconductor device and the first semiconductor device no longer conducts from drain to source thereby turning off the gate of the second semiconductor device and causing the second semiconductor device to stop conducting current drain to source removing power to a load and lighting driver enters the standby mode.

14. The control method of claim 12, wherein the first and second semiconductor devices are n-channel type and p-channel type metal-oxide semiconductor field-effect transistors, respectively.

15. The control method of 14, further comprising generating, by the peak detection circuit, a delay is generated in the standby control signal.

16. The control method of claim 10, wherein upon receiving the message from the control system, generate, via the microcontroller, a pulse width modulation signal as the output reference control signal.

17. The control method of claim 16, wherein the standby control signal is an exponentially decaying signal that is recharged at each pulse of the output reference control signal.

* * * * *